US005975753A

United States Patent [19]

Meyer

[11] Patent Number: 5,975,753

[45] Date of Patent: Nov. 2, 1999

[54] MIXING TOOL WITH OVERLAPPING SWEEP RODS

[75] Inventor: Thomas Meyer, Paderborn, Germany

[73] Assignee: Gebrüder Lödige Maschinenbau-Gesellschaft mit beschränkter Haftung, Paderborn, Germany

[21] Appl. No.: 09/136,068

[22] Filed: Aug. 19, 1998

[30] Foreign Application Priority Data

Oct. 4, 1997 [DE] Germany ..... 197 43 923

[51] Int. Cl.[6] ..... B01F 7/04

[52] U.S. Cl. ..... 366/313; 366/325.1

[58] Field of Search ..... 366/25, 64–67, 366/102–104, 312, 313, 309, 319, 325.1, 325.92, 329.1, 342, 343

[56] References Cited

U.S. PATENT DOCUMENTS

| | | | |
|---|---|---|---|
| 1,156,050 | 10/1915 | Brierley | 366/313 |
| 2,106,529 | 1/1938 | Keller | 366/329.1 |
| 2,488,053 | 11/1949 | Damrow | 366/312 |
| 3,544,081 | 12/1970 | Eckhardt | 366/313 |
| 3,843,101 | 10/1974 | Green . | |
| 4,310,124 | 1/1982 | Schwing et al. | 366/329.1 |
| 4,552,461 | 11/1985 | Ott et al. | 366/312 |
| 5,121,992 | 6/1992 | List et al. . | |
| 5,380,084 | 1/1995 | Milstead | 366/25 |
| 5,407,273 | 4/1995 | Wilson | 366/313 |

FOREIGN PATENT DOCUMENTS

| | | | |
|---|---|---|---|
| 749229 | 12/1966 | Canada | 366/319 |
| 262961 | 12/1988 | German Dem. Rep. . | |
| 448197 | 7/1927 | Germany | 366/325 |
| 1177620 | 9/1964 | Germany . | |
| 29504562 | 6/1995 | Germany . | |
| 4344995 | 7/1995 | Germany . | |
| 61-143401 | 7/1986 | Japan | 366/325 |

*Primary Examiner*—Charles E. Cooley
*Attorney, Agent, or Firm*—Paul Vincent

[57] ABSTRACT

A mixing tool 10 can be mounted within a drum 20. A mixing arm 12 of the mixing tool 10 can be held by a shaft borne in a rotatable fashion. A mixing body 11 is mounted to the mixing arm 12 and directed towards the inner surface of the drum. One or more rods 13 are introduced onto the outer surface 14 of the mixing body 11 and have a prominent mixing edge 18. A mixing tool of simple construction is developed with which nearly all mixable bulk products and/or product mixtures can be processed without leading to the formation of product deposits in the region between the inner surface of the drum and the mixing body 11.

6 Claims, 2 Drawing Sheets

MIXING TOOL WITH OVERLAPPING SWEEP RODS

This application claims Paris Convention priority of German patent application 197 43 923.3 filed Oct. 4, 1997, the complete disclosure of which is hereby incorporated by reference.

BACKGROUND OF THE INVENTION

The present invention concerns a mixing tool for attachment within a drum the mixing arm of which is mounted to a rotatably borne shaft and whose mixing body, mounted on the mixing arm is directed towards the inner surface of the drum.

A mixing tool of this type has become known in the art e.g. through DE 43 44 995 A1.

Mixing tools have been known in the art for decades and are used in substantially horizontally directed drums to mix bulk products and liquids of all kinds. The mixing tools are thereby mounted to a shaft which is rotatably borne in the drum. In order to achieve as complete a mixing of the bulk products as possible, the mixing tools should penetrate in particular through the bulk product whirling at the inner surface of the drum. Towards this end, the mixing tools are disposed within the drum in such a fashion that the separation of the mixing tools with respect to the inner surface of the drum is small. Due to expansion of the material (of the drum and/or of the mixing tool) or due to the intrinsic weight of the mixing tool, the separation between the mixing tool and the inner surface of the drum can decrease. A safety margin is therefore always required between the mixing tool and the inner surface of the drum.

When mixing particular products, a fraction of the bulk product can become attached to the surface of the drum in the region between the mixing tool and the inner surface of the drum. In particular, bulk products having sticky and hardening components tend to produce this type of product deposit. This sticky and hardened portion of the processed product interferes with the operation of the mixing tools. The tools can then undergo wear even after short operation times and/or the quality of the product being processed is compromised.

For this reason, prior art has already used so-called "cleat blades" as, e.g. known in the art from the brochure "Industrial Mixing in Continuously Operating Lödige-Mixers" from the company Lödige, published in 1993. These cleat blades attempt to positively influence the properties of the product deposit formed. The product deposit on the inner surface of the drum is broken-up by the cleat portion of the mixing tool during mixing. If, however, the mixing product has components which harden relatively quickly and which can form a hard product deposit, the action of such a cleat blade is insufficient to completely suppress formation of a product deposit on the inner surface of the drum.

In order to avoid this problem, prior art has already proposed introducing two cleat profiled mixing tools on one mixing arm. The overlapping of two cleat profiles allows for better processing of the product deposit. However, the mixing arm is subject to substantial load during the mixing process due to the presence of two mixing bodies having cleated sections. In addition, the inner volume of the drum available for accepting bulk product is disadvantageously reduced.

The technical problem underlying the present invention is therefore to develop a simply constructed mixing tool through the use of which nearly all bulk products or product masses which tend to produce product deposit can be processed without having material deposition occur in the region between the inner surface of the drum and the mixing body.

SUMMARY OF THE INVENTION

This technical problem is solved in accordance with the invention in that one or more rod-shaped sweeping elements are introduced onto the upper surface of the mixing body to sweep across regions of the inner surface of the drum during rotation of the shaft.

The mixing tool in accordance with the invention consists essentially of a mixing body to which sweep elements are mounted. Available blades of conventional mixing tools can therefore be used as a basis for the mixing tool to which the sweeping elements can be introduced at a certain angle. The sweeping elements in accordance with the invention can be formed on all conventional mixing tools.

Rotation of the shaft causes the sweep elements to pass through the bulk product located on the inner surface of the drum so that this region is combed through by the sweep elements within the drum. The inner wall of the drum can therefore be kept free of deposit or of product. The bulk product can be scratched-off, scraped-off or wiped-off the inner surface of the drum at the inner drum wall. A plurality of sweep elements are combined into a comb, a rake, a fork or the like. Defined and directed engagement of a plurality of sweep elements having a certain length prevents even rapidly hardening products from attaching to the inner surface of the drum and/or depositing thereon. The sweep elements facilitate an intensive processing of the bulk product. The sweep elements can have differing cross-sectional shapes in dependence on the type of bulk product.

The free operation over large regions of the inner surface of the drum is supported when the sweep elements sweep over regions of the inner surface of the drum during rotation of the shaft. The sweep elements are disposed on the mixing bodies transverse to the radial axis of the drum. When the shaft rotates through 360° the sweep elements sweep over a region at the inner surface of the drum having a width determined by the length of the sweep element.

In a preferred embodiment, the sweep elements have at least one prominent mixing edge in order to penetrate into the solidified bulk product deposit. Repeated breaking-up and passing-through the product deposit with the assistance of the mixing edge leads to a breaking-up in the product deposit and its separation from the inner surface of the drum.

In another embodiment, two sweep elements are introduced onto the mixing tool in such a fashion that, in consequence of the rotation of the shaft, one sweep element, following processing of its processing region, is subsequently guided through a processing region of the other sweep element. The sweep elements have mutually overlapping processing regions. Each processing region on the inner surface of the drum is combed through a plurality of times in dependence on a number of sweep elements to remove product deposits. In this fashion, the formation of hardening bulk product deposits is more effectively prevented. The overlap of the processing regions prevents the formation of bulk product deposits of saw-tooth shape on the inner surface of the drum.

If the sweep elements are curved with a radius of curvature adapted to the radius of the drum, the separation between the mixing body or the sweep element and the inner surface of the drum can be kept as small as possible. Clearly, this further reduces the possible sticking of product to the inner surface of the drum.

In an additional preferred variation, an end of a sweep element trailing in direction of travel of the mixing tool is further separated from the inner surface of the drum than a leading edge of the sweep element. A free angle is formed between the inner surface of the drum and the sweep element. This differing separation of the sweep elements from the inner surface of the drum allows for a better scraping of the solidifying bulk product deposits from the inner surface of the drum. Saw-tooth product deposits are avoided.

The sweep elements have a material coating to improve the stability and prolong the operating life of the mixing tool in accordance with the invention. The material coating can comprise a coating which prevents the sticking or bonding of bulk product components to the sweep elements.

Due to a possible stretching in consequence of the load of the mixing tools, the sweep elements are slightly separated from the inner surface of the drum. For optimized cleaning of the inner surface of the drum during the mixing process it would, however, be desirable to have the sweep elements seat on the inner surface of the drum. Towards this end the back surface of the sweep element facing the inner surface of the drum is provided with an elastomer coating adapted for seating on the inner surface of the drum. The sweep elements can seat with this flexible back surface on the inner surface of the drum without blocking the motion of the mixing tools. Other coatings having similar resilient properties could also be used instead of the elastomer coating.

The metallic sweep elements can be formed or welded onto the mixing tool. It would also be conceivable to dispose the sweep elements on the mixing tool in a detachable fashion to direct the sweep elements differently in dependence on the bulk product. One must only take care that the connection between the mixing head and the sweep element is sufficiently strong. This can be problematic particularly for very strongly bonding bulk product components so that attachment by means of weldment is preferred.

The mixing tools in accordance with the invention can be used in mixers, dryers, and reactors which work continuously or discontinuously in which products tending to build deposits are processed.

Further features and advantages of the invention can be derived from the subsequent description of an embodiment of the invention with regard to the drawing which shows important details for the invention as well as from the claims. The individual features can be utilized individually or collectively in arbitrary combination in embodiments of the invention.

DESCRIPTION OF THE PREFERRED EMBODIMENT

The invention is schematically shown in the figures so that the essential features of the invention can be easily recognized. The figures are not necessarily to be taken to scale.

Figure 1:
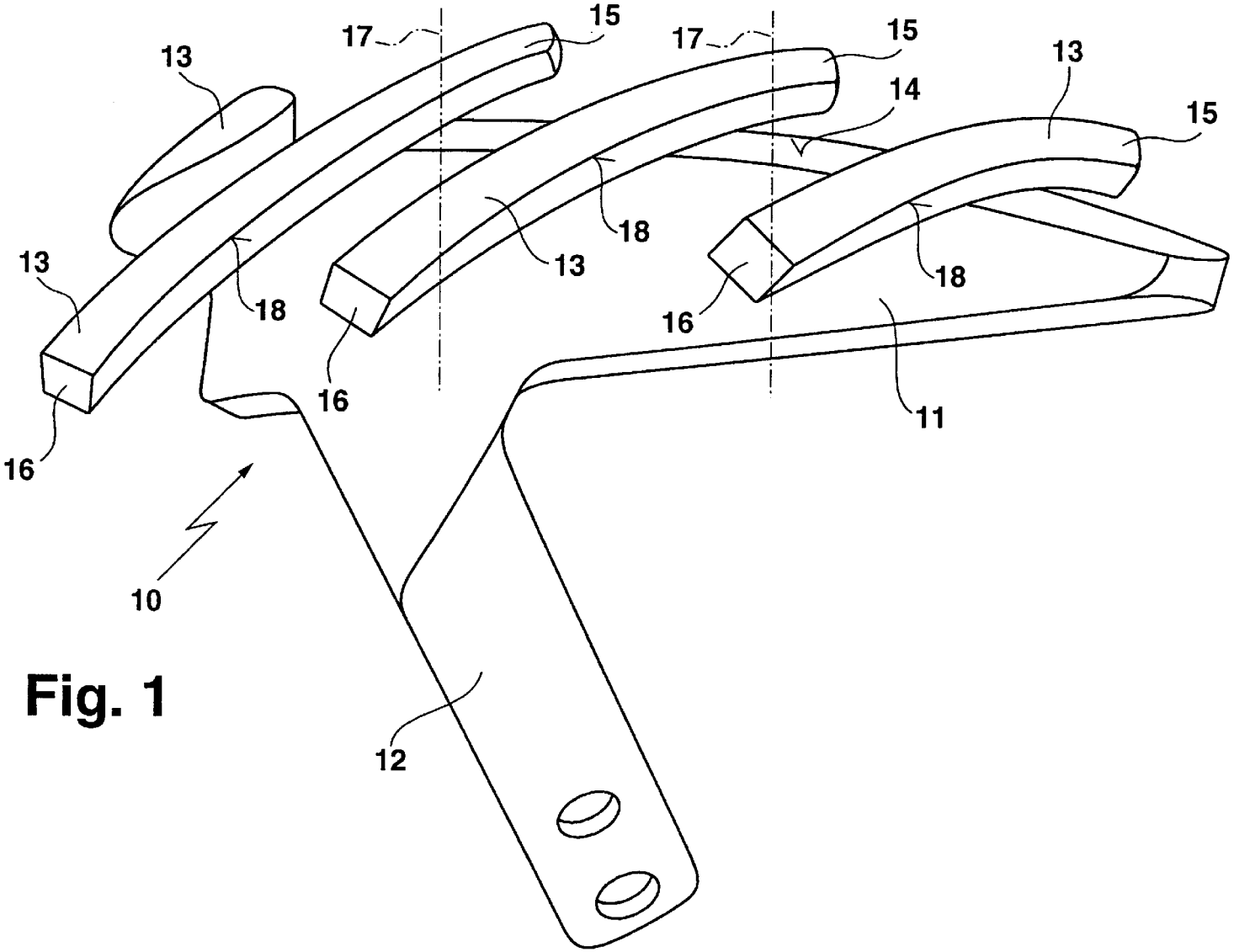
FIG. 1 shows a three-dimensional view of a mixing tool in accordance with the invention.

In accordance with the perspective view of FIG. 1, a mixing tool 10 consists essentially of a mixing body 11 and a mixing arm 12. The mixing arm 12 has attachment holes with the assistance of which the mixing arm 12 can be mounted to a rotatable shaft inside of the drum (see FIG. 2). The mixing body 11 is used for mixing bulk products within the drum. In the installed state of the mixing tool 10, the mixing body 11 faces an inner surface of the drum at a separation therefrom. Bulk products having bulk product components which tend to harden or stick can lead to the formation of bulk product deposits which bond to the inner surface of the drum. The mixing tool 10 has rod-shaped sweep elements 13 to prevent formation of this bulk product deposit. The sweep elements 13 are formed by four-sided rods which are welded to an outer surface 14 of the mixing body 11. Other cross-sectional shapes and mounting procedures can also be used for the sweep elements 13.

The rod-shaped sweep elements 13 form a kind of comb or rake for processing the hardened bulk product located in the vicinity of the inner surface of the drum. The sweep elements 13 are slightly curved to adapt to the drum radius. The sweep elements 13 can therefore move along the inner surface of the drum at very small separations therefrom. The sweep elements 13 are disposed on the mixing body in such a fashion that, in each case, a leading end 15 and a trailing end 16 of two sweep elements 13 cross through a transverse axis 17 which is perpendicular to the longitudinal axis of the drum. Processing regions of two sweep elements 13 overlap to prevent formation of saw-tooth shaped product deposit on the inner surface of the drum. Bulk product regions are therefore not only processed by one rather by a plurality of sweep elements 13 and are removed from the inner wall of the drum. Mixing edges 18 can cut into and break up the bulk product deposit (product deposit).

Figure 2:
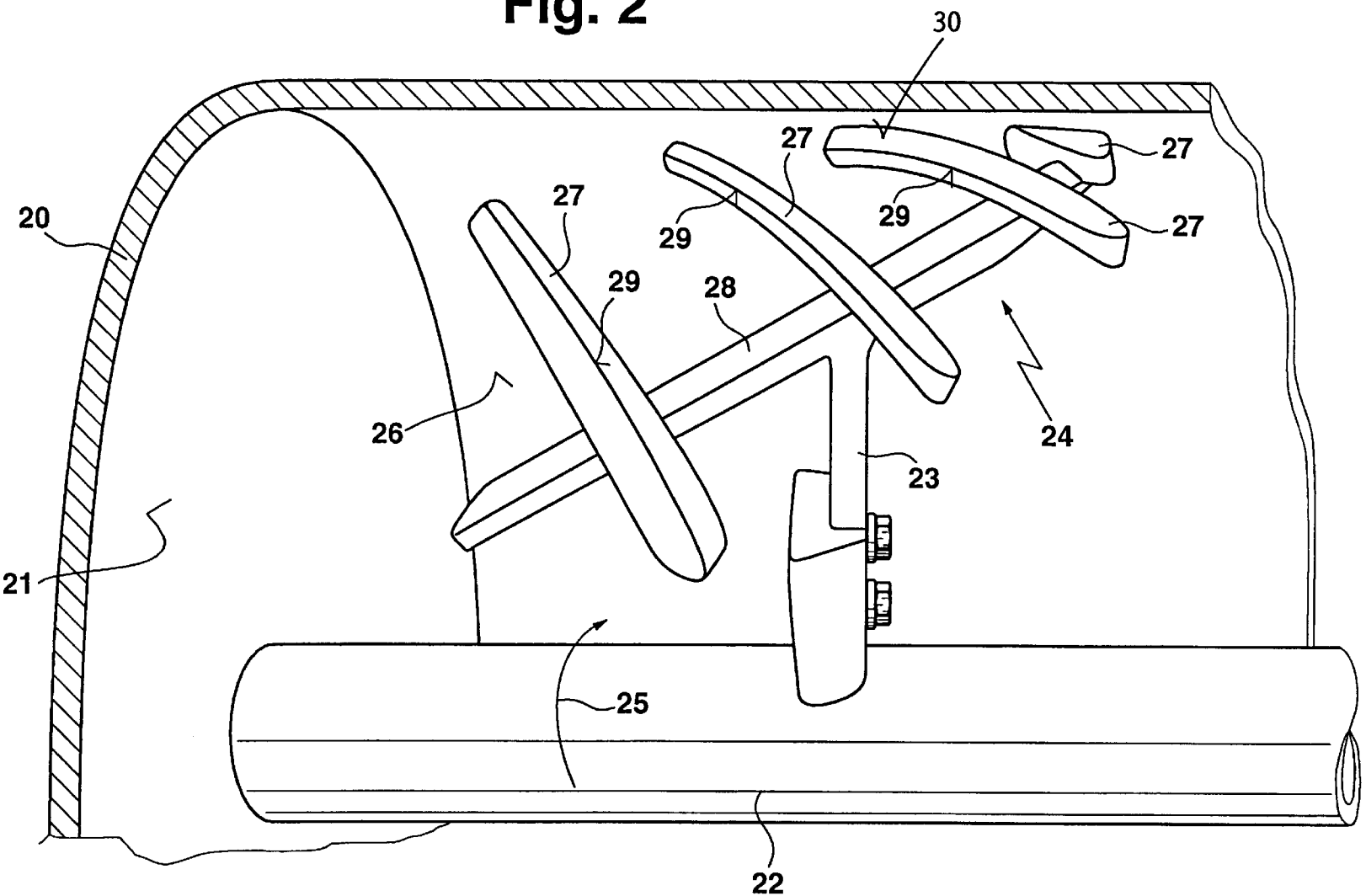
FIG. 2 shows an inner view of a drum in which an additional mixing tool in accordance with the invention is attached to a shaft.

FIG. 2 shows an inner view of a drum 20. A shaft 22 is borne in a rotatable fashion on the ends 21 of the horizontal drum 20. A mixing arm 23 of the mixing tool 24 is mounted to the shaft 22. The mixing tool 24 moves along an inner surface of the drum 26 when the shaft 22 is rotated in the direction of arrow 25. Sweep elements 27 having a triangular-shaped cross-section can thereby scrape bonding and/or hardening components of the bulk product from the inner surface of the drum 26. The sweep elements 27 are slightly curved and mounted to a mixing body 28 in a sufficiently stable manner. The formation of the mixing edge 29 on the sweep elements 27 facilitates good penetration into the bulk product hardening and bonding at regions of the inner surface of the drum 26. Rotational motion of the mixing tool 24 along the inner surface of the drum 26 leads to overlapping of the individual processing regions of each sweep element 27 so that the bulk product is processed by more than one sweep element 27. Saw-tooth shaped deposits of bulk product bonding to the inner surface of the drum 26 are thereby avoided.

The sweep elements 27 are made from metal and can have an appropriate material coating 30 to prolong their operation time. The separation between the inner surface of the drum 26 and the sweep elements 27 can be compensated for by introducing an elastomer coating 30 onto the sweep elements 27 of a sufficient thickness. This elastic appendage can scrape or wipe the inner surface of the drum 26.

A mixing tool 10 can be mounted within a drum 20. A mixing arm 12 of the mixing tool 10 can be held by a shaft mounted in a rotatable fashion. A mixing body 11 is introduced on the mixing arm 12 and directed towards the inner surface of the drum. One or more rod-shaped sweep elements 13 are introduced onto the outer surface 14 of the mixing body 11 and have a prominent mixing edge 18. A mixing tool of simple construction is developed by means of which nearly all mixable bulk products and/or product mixtures can be processed without leading to the formation of product deposits in the region between the inner surface of the drum and the mixing body 11.

I claim:

1. A mixing tool for attachment to a shaft rotating within a drum, the drum having an inner wall, the mixing tool comprising:

a mixing arm mounted to the shaft;

a mixing body mounted to said mixing arm between said mixing arm and the inner wall;

a first rod shaped element mounted to an outer surface of said mixing body to sweep through a portion of the inner wall when the shaft is rotated; and a second rod shaped element mounted to said outer surface of said mixing body, wherein said first rod element sweeps through a first swath on the inner wall and said second rod element sweeps through a second swath on the inner wall, said second swath substantially overlapping said first swath to prevent formation of saw-tooth shaped product deposit on the inner wall.

2. The mixing tool of claim 1, wherein said rod elements each have a prominent mixing edge facing the inner wall.

3. The mixing tool of claim 1, wherein said first rod element has a radius of curvature corresponding to a radius of curvature of the drum.

4. The mixing tool of claim 1, further comprising a material coating disposed on said first rod element.

5. The mixing tool of claim 4, wherein a back surface of said first rod element facing the inner wall has an elastomer coating adapted for seating on said inner wall.

6. The mixing tool of claim 1, wherein said first rod element is one of integral with and welded to said mixing body.

* * * * *